United States Patent [19]

Skriletz

[11] 4,076,779

[45] Feb. 28, 1978

[54] METHOD OF RESTORING THE FLUID PERMEABILITY OF A USED, CERAMIC FLUID-RELEASE MOLD

[75] Inventor: Rudolph A. Skriletz, Marysville, Ohio

[73] Assignee: Wallace-Murray Corporation, New York, N.Y.

[21] Appl. No.: 601,086

[22] Filed: Aug. 1, 1975

[51] Int. Cl.[2] ..... B28B 7/38

[52] U.S. Cl. ..... 264/39; 134/3; 264/233; 264/335; 264/344

[58] Field of Search ..... 264/36, 39, 233, 344, 264/49, 335; 134/3, 28

[56] References Cited

U.S. PATENT DOCUMENTS

| | | | |
|---|---|---|---|
| 2,502,337 | 3/1950 | Moir | 134/3 |
| 2,584,109 | 2/1952 | Blackbarn et al. | 264/86 |
| 2,652,360 | 9/1953 | Bond et al. | 134/3 |
| 3,641,229 | 2/1972 | Lawrence et al. | 264/86 |
| 3,708,014 | 1/1973 | Wally | 134/3 |

FOREIGN PATENT DOCUMENTS

| | | | |
|---|---|---|---|
| 673,239 | 6/1952 | United Kingdom | 264/39 |

*Primary Examiner*—Robert F. White
*Assistant Examiner*—John Parrish
*Attorney, Agent, or Firm*—Schuyler, Birch, Swindler, McKie & Beckett

[57] ABSTRACT

A method of restoring the fluid permeability of the surface of the mold face of a used, ceramic, fluid-release mold body which has become fouled with accumulated silicate material from the plastic clay composition formed by the mold, comprising treating the fouled surface with a fluorine containing acid such as fluosilicic acid, or hydrofluoric acid.

31 Claims, 7 Drawing Figures

METHOD OF RESTORING THE FLUID PERMEABILITY OF A USED, CERAMIC FLUID-RELEASE MOLD

BACKGROUND OF THE INVENTION

The use of air-release molding has been widely adopted in the ware-forming industry. The most common process involves pressing a quantity of plastic clay between cooperating male and female molds or dies formed of porous, fluid-permeable material. In addition to shaping the ware, the pressing operation also substantially dewaters the clay by forcing excess water into the pores of the molds. Release of the shaped ware, which adheres to the mold faces, is accomplished without distorting or damaging the ware by applying fluid pressure to a fluid permeable conduit communicating with one of the porous mold bodies so that the fluid passes from the conduit, diffuses through the porous mold body, and exits through the mold face as a uniform blanket shortly before the male and female mold members are separated. The shaped clay ware adheres to the other mold member which is transferred to a ware depositing station where fluid pressure is applied in a like manner to the other mold member to complete the release of the formed article. This basic process is disclosed in U.S. Pat. No. 2,584,109 and U.S. Pat No. 2,584,110.

Porous, fired ceramic materials have come into use as fluid-permeable, air-release mold bodies because of their high strength and wear resistance. Such materials are disclosed in U.S. Pat. No. 3,384,499 and U.S. Pat. No. 3,641,229. In practice, it has been found that after such molds have been used for several thousand forming operations, the formed clay articles stick to the molds. The number of pressing operations which can be completed before objectionable sticking occurs varies with the procedures of the particular pressing operation involved and with the composition of the plastic material pressed by the mold. While in some few instances over ten thousand pressings can be effected before sticking will occur, the average number of pressings which can be effected before sticking lies between six thousand and eight thousand forming operations. When sticking occurs, tests show that the fluid permeability of the mold face has decreased to such an extent that it is not possible to secure proper release of the formed clay article from the mold. Once formed articles start to stick to the mold, the mold must either be rehabilitated or it must be discarded despite the fact that the mold face is not appreciabily worn or broken. It has been determined that the decrease in porosity of the molds results from accumulation of material from the clay formed by the mold, in the pores near the surface of the mold body. Qualitative spectrographic analysis of scrapings of the accumulated material indicates, in addition to the presence of alumina from the mold, the presence of potassium and significant amounts of silicon. Photomicrographs of the accumulated material on the surface of a fouled mold show it to be amorphous, having no apparent grain definition or crystalline structure. This suggests that the material is comprised of colloidal particles which were originally dispersed in the plastic clay composition formed by the mold and which were deposited from the clay composition formed by the mold and which were deposited from the clay over the course of repeated forming operations. It is presently believed that the accumulated material principally comprises colloidal silicates from the plastic clay composition formed by the mold.

The accumulation of silicate material from the plastic clay pressed by the mold on the surface and in the pores of the mold body is evidenced by the fact that the surface of the mold face, which initially is light tan in color, assumes a dark, murky brown tone. This accumulation of material so reduces the flow of air out the mold face that release of the formed clay articles from the mold body is impaired and sticking results. This results in a large number of surface imperfections and/or structural flaws due to uneven stresses which in turn produce a large percentage of rejects at the kiln.

Attempts to recondition the molds by washing the accumulated silicate material away with strong acids such as nitric acid, hydrochloric acid or sulfuric acid; with weak acids such as acetic acid; with solvent materials such as kerosene or gasoline; or with weak bases such as ammonium hydroxide or caustic bases such as sodium hydroxide or potassium hydroxide have all been unsuccessful.

Heretofore, the only successful method of restoring the fluid permeability of a used, porous, ceramic mold body which had become fouled with silicates, was to abrade the mold face by sanding or sandblasting as disclosed in U.S. Pat. No. 3,828,488. While such procedures are effective to substantially restore the fluid permeability of the used molds, sanding or sandblasting, even when carried out in the most careful manner, gradually erodes away the surface of the mold face so that after the abrading procedure has been carried out a few times, details of the mold are obliterated, the surface of the mold face is destroyed and dimensional tolerances for the mold are exceeded. Naturally, the exact number of times a given mold can be reconditioned by sandblasting will vary depending on the composition of the mold body, the conditions under which the mold body was fired, the degree of detail in the mold and the required dimensional tolerances for the ware to be produced. Molds used to produce large items which are provided with a heavy glaze, such as toliet tank covers, may be reconditioned as many as five to eight times by careful sandblasting, but fine articles where the surfaces are critical, such as dinnerware, cannot be acceptably produced with molds which have been sandblasted even once. Ordinarily, it may be stated, that the number of times an alumina containing, fired ceramic, porous air-release mold may be reconditioned by sanding or sandblasting will not exceed five or ten times. Thus, after such a mold has been reconditioned just a few times, it is no longer possible to recondition it, and it must be discarded.

If the number of times an alumina containing, porous, fired ceramic mold body could be reconditioned could be significantly increased, significant savings would accrue to the ware forming industry, because the number of expensive replacement molds required would be correspondingly reduced.

Accordingly, it is an object of the present invention to provide a method for reconditioning a porous, fired ceramic mold by removing accumulations of silicate material from the surface and the pores of the mold face.

It is an object of the present invention to provide a method of reconditioning a used, porous, fired ceramic mold body wherein accumulated silicate material is removed by chemical means.

It is a further object of the present invention to provide a method for reconditioning used, porous, fired ceramic mold bodies wherein the removal of accumulated silicate material is effected without significant destruction of the surface of the mold face.

SUMMARY OF THE INVENTION

These and other objects of the invention are achieved by providing a method for restoring the fluid permeability of a used, porous, fired ceramic mold body having a mold face formed thereon comprising treating the mold face of the mold body with a fluorine containing acid.

In one preferred form of the invention, the method comprises applying a fluorine containing acid, such as 30% fluosilicic acid, to the mold face of a mold body; maintaining contact between the acid and the mold body for a period of from about 1 to about 2 minutes whereby the acid reacts with the accumulated material and soaks into the pores of the mold body; applying pressurized fluid to the mold body whereby fluid is forced to diffuse through the porous mold body and exit through the mold face to purge acid from the mold body and rinsing the acid from the mold face of the mold body.

DETAILED DESCRIPTION OF THE PREFERRED EMBODIMENTS

Figure 1:
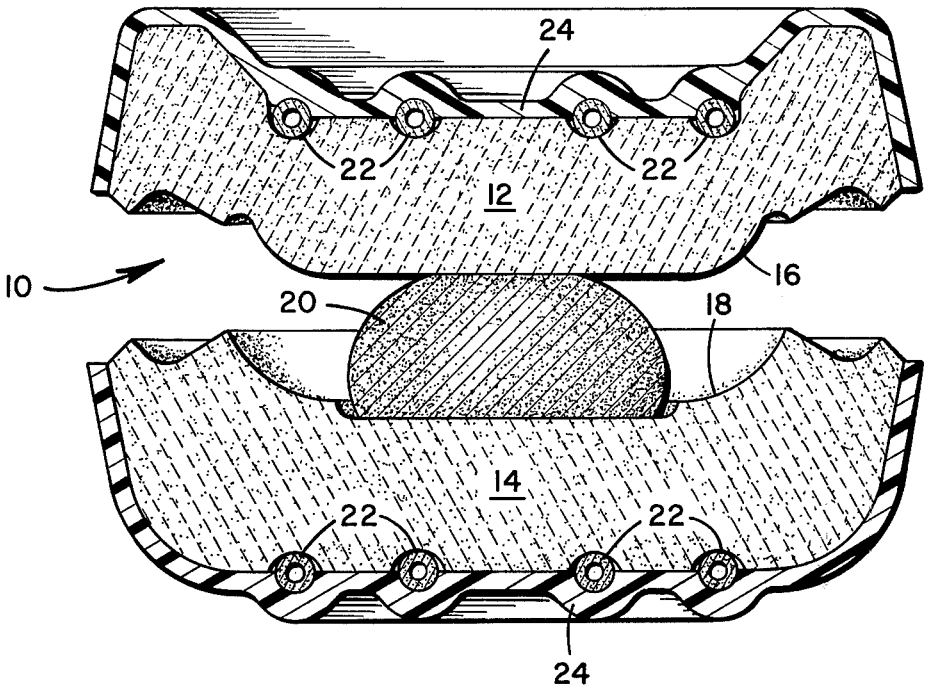
FIG. 1 is a sectional view of a porous, fired ceramic fluid-release press mold.

FIG. 1 shows a porous, fired ceramic fluid-release mold generally designated by reference numeral 10 comprising a male mold body 12 and a female mold body 14. The illustrated mold is designed to produce a small square dinner plate about 8 inches by 8 inches in size. Mold bodies 12 and 14 are each provided with mold faces 16 and 18 respectively, between which a body of plastic clay material 20 is formed to a desired shape by pressing the mold bodies together with the clay between them. Air-permeable woven fabric conduits or tubes 22 are disposed against the back surfaces of mold bodies 12 and 14, and the back surfaces of the mold bodies are covered with a layer of resinous material 24 to seal the fluid permeable tubes to the mold bodies and to seal the back surfaces of the mold bodies against egress of fluid therethrough. Tubes 22 are adapted to be connected to a source of pressurized air (not shown). When pressurized air is supplied to tubes 22, the air diffuses through the walls of the tubes into the porous mold bodies 12 and 14 and then out the mold faces of the mold bodies.

Mold bodies 12 and 14 are formed from an alumina containing ceramic material fired to a point short of the maximum theoretical density for such material so that the resulting fired bodies have a porosity lying in the range from about 25 to about 45%, preferably about 35 to about 40%. A preferred composition for the ceramic material is disclosed in U.S. Pat. No. 3,384,399 and comprises at least about 70% alumina up to about 15% ball clay and up to about 15% talc. Further details of the mold construction are disclosed in copending application Ser. No. 533,960, filed Dec. 18, 1974, entitled "Fluid-Release Mold."

In operation, a body of plastic clay 20 is placed between the two mold bodies and the mold bodies 12 and 14 are pressed together until the plastic clay is formed to the desired shape between them. Compressed air is then introduced through fluid-permeable tubes 22 mounted on mold body 14. The air passes through the tube walls into the porous mold body and exits from the mold body through the mold face 18 as a uniform blanket. Egress of the air through the back of mold body 14 is prevented by the coating of resinous material 24. The air exiting through mold face 18 releases formed clay article from mold body 14. As the blanket of air releases the formed clay article from mold body 14, mold bodies 12 and 14 are separated, and mold body 12, with the formed clay article adhering thereto, is transferred to a ware depositing station. Compressed air is then introduced through the fluid-permeable tubes 22 mounted on mold body 12. The air passes through the tube walls into mold body 12 and exits from the mold body through mold face 16 as a uniform blanket which releases the formed clay article from mold body 12. A fresh lump of plastic clay is deposited in mold body 14; mold body 12 is returned to the forming station, and the sequence of operations is repeated to produce another formed clay article.

Figure 2:
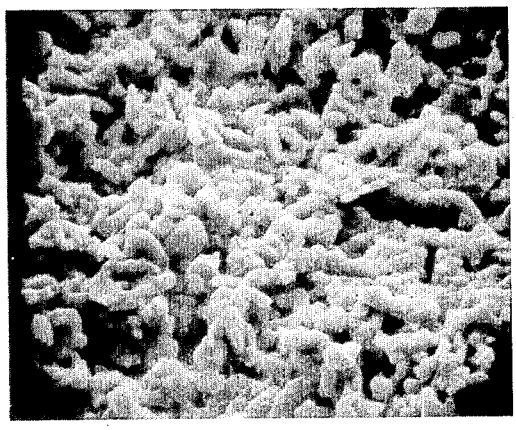
FIG. 2 is a microphotograph of the surface of a new mold of the type illustrated in FIG. 1.

FIG. 2 is a photomicrograph of the surface of the mold face of an alumina containing, porous, fired ceramic mold body of the type illustrated in FIG. 1 enlarged two thousand times. FIG. 2 shows a "new" mold, i.e., a mold that has never been used to form plastic clay to the desired shaped articles. The mold body is shown to consist of small particles of material fused or sintered together at discrete points with substantial openings and crevices therebetween. The porous nature of the mold body is apparent from the photograph.

Fired ceramic molds have much greater hardness and strength and thus have much greater wear resistance and resistance to breaking than plaster fluid-release mold bodies. Consequently the expected average service life of such molds is much greater. However, as noted above, after such molds have been used to produce several thousand formed clay articles, the formed articles start to stick to the molds and will not release properly when the compressed air is applied.

The number of forming operations which may be performed before sticking occurs may vary from about four or five thousand to more than ten thousand depending on the size and shape of the article being produced, the formulation of the plastic clay used to produce the formed articles and other factors. Typically sticking starts to occur between six and eight thousand forming operations. This sticking causes surface defects, and in some instances even leads to structural flaws, in the formed articles. Such pieces require extra finishing or must be totally rejected. This sticking poses a serious problem for the manufacturer. Once formed articles start to stick to a mold, the fluid permeability of the mold must be restored, or the mold must be discarded. Such molds are expensive, and premature replacement results in serious economic loss.

As previously noted, examination of molds where sticking has started to occur reveals that the fluid permeability of the surface of the mold face has decreased due to accumulation of material from the clay on the surface and in the pores near the surface of the mold face. The accumulation of material is further evidenced by the fact that the original light tan color of the mold face has changed to a dark, murky brown tone. Spectroscopic analysis of scrapings of the accumulated material suggests the principal component of the accumulated material is silicates. The accumulated silicate material fouls the surface of the mold face reducing the amount of compressed air that can be forced through the mold body and preventing the air from exiting through the mold face as a uniform blanket. Sticking of the formed articles starts to occur when the fluid permeability of the mold face is reduced to the degree that complete separation of the formed clay article from the mold is not effected.

Figure 3:
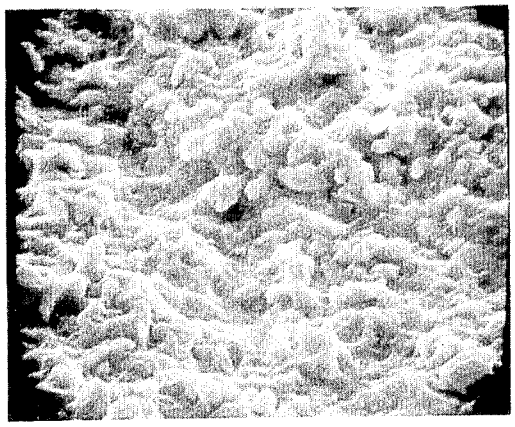
FIG. 3 is a microphotograph of the surface of a used mold of the type shown in FIG. 1 showing the accumulation of silicate material.

FIG. 3 is a photomicrograph of the surface of the mold face of a mold corresponding to the mold illustrated in FIG. 2 except that the mold shown in FIG. 3 has been used for approximately 12,000 pressing operations. The accumulation of silicate material fouling the surface and clogging the pores of the mold face appears very clearly in the photograph. Even at 2,000 X magnifications no grain definition or crystalline structure can be seen in the photograph of the accumulated material. This suggests that the material comprises particles of colloidal size originally dispersed in the clay formed in the mold which gradually deposit on the surface and in the pores of the mold over the course of repeated forming operations.

Figure 4:
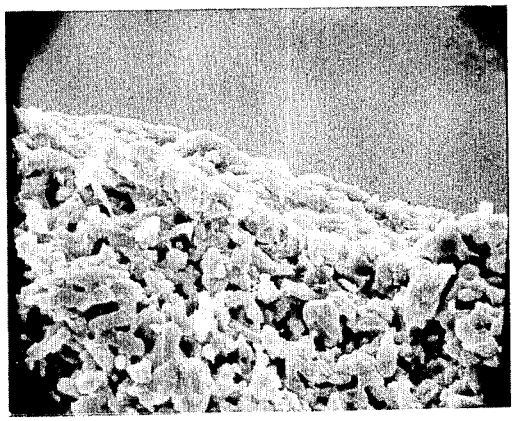
FIG. 4 is a sectional microphotograph of a used mold which shows how the silicate material accumulates on the surface and penetrates into the pores near the surface of the mold face.

FIG. 4 is a sectional photomicrograph of the mold illustrated in FIG. 3 which shows how the silicate material penetrates down into the pores of the mold body. FIG. 4 shows a slight, but noticeable, penetration of the silicate material from the clay down into the pores of the mold body. The penetration of silicate material into the pores makes it impossible to remove the accumulated silicate material by abrasive methods without damaging the surface of the mold.

Figure 5:
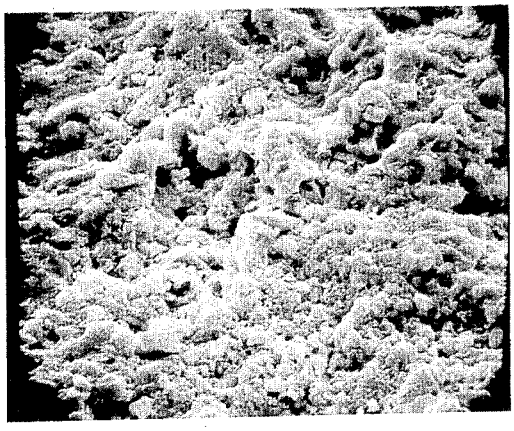
FIG. 5 is a microphotograph of the surface of a mold of the type illustrated in FIG. 1 which has been reconditioned by sandblasting.

FIG. 5 is a photomicrograph corresponding to FIGS. 2 and 3 which shows the surface of the mold face of a mold body which has been reconditioned by sandblasting. Removal of significant amounts of the silicate material from the mold surface is evident; however, it is also evident that the surface of the mold has been damaged and eroded away during the sandblasting operation. Obviously, repeated treatment of this type will destroy the usefulness of the mold. Moreover, while fluid-permeability of the mold may be substantially restored, it is apparent that a portion of the silicate material which penetrates into the pores of the mold body is not entirely removed.

Attempts to clean fouled molds with strong acids such as nitric acid, hydrochloric acid and/or sulfuric acid and weak acids such as acetic acid have not been successful. Experiments with strong bases such as sodium hydroxide and potassium hydroxide and with solvents such as kerosene and gasoline showed that these substances were also unable to clean the material from the pores of the mold bodies.

It has now been discovered that the accumulation of silicate material can be effectively removed by treating the mold surface with a fluorine containing acid. Such acids include fluosilicic acid ($H_2SiF_6$), hydrofluoric acid (HF), fluosulfonic acid ($HSO_3F$), fluorophosphoric acid ($H_2PO_3F$), hexafluorophosphoric acid ($HPF_6$) and trifluoroacetic acid ($C_2HO_2F_3$). The most preferred acids are fluosilicic acid and hydrofluoric acid.

The fluorine containing acids have the ability to attack the silicate material and dissolve it, but the acids do not appreciably attack the alumina containing ceramic material and thus do not destroy the surfaces of the mold faces of the mold bodies nor obliterate details of the molds.

In its simplest form, the invention comprises applying a fluorine containing acid to the surface of an alumina containing, porous, fired ceramic mold body which has become fouled with silicate material, maintaining contact between the acid and the fouled surface for a period of time sufficient for the acid to attack the silicate material, and thereafter removing the acid and the residue of the silicate material from the surface of the mold body.

Treatment times vary somewhat depending on the acid utilized, the degree of fouling of the mold surface, and the composition of the plastic clay material formed by the mold which determines the composition of the accumulated silicate material. Ordinarily the duration of each individual treatment will range from about 0.5 minutes to about 5 minutes. Repetitive treatments are generally desirable and often necessary.

The quantity of acid which should be applied likewise varies with the particular fluorine containing acid utilized, the composition of the accumulated material, the degree of fouling of the mold surface, and the treatment time. In general from about 0.02 to about 2.0 ml of acid per square centimeter of mold face surface area will be an appropriate amount of acid solution.

Application of the acid may be made in a number of ways such as brushing acid solution on the mold face surface with an inert brush or spraying acid solution on the mold face surface with an atomizing sprayer.

Removal of the acid from a cleaned mold may also be accomplished in a number of ways. For example, the simplest removal procedure is to force pressurized air through the mold body and out the mold face in the same manner as is done in releasing a formed article. Acid is carried out of the pores of the mold body and removed from the mold face by the flow of air.

Better results are obtained by rinsing the mold face with water, allowing the water to soak a few millimeters into the mold body behind the mold face, and then blowing pressurized air through the mold to remove the acid and the water and dry the mold. The water rinsing may be executed merely by spraying a hose against the mold face. Adequate penetration of the water beneath the surface of the mold face will occur in as little as five to ten seconds depending on the porosity of the mold body.

Generally, the acid washing treatment will be repeated until the mold face of the mold body is completely clean. Except under the most extreme circumstances, fewer than ten repetitions will provide a completely clean mold surface. Ordinarily from three to six repetitions is sufficient.

Following the final acid treatment and rinsing operations, it is preferred to purge the die with compressed air for a period of time of approximately ten to fifteen minutes in order to ensure all of the acid is removed and the mold is thoroughly dry.

It is also possible to force water at pressures from 10 to 100 or more psi through the release air conduit into the mold body and and out through the mold face to effect a complete flushing of the mold body. Water flushing should be carried out for from five to fifteen minutes. After such treatment, air should be passed through the mold body for from ten to thirty minutes in order to remove all water and thoroughly dry the mold body.

Cleaning of the mold body faces is effected according to the following procedures. Acid is brushed onto the fouled mold face of a used mold body with a soft bristle brush such as an ordinary nylon bristle or camel's hair bristle paint brush. The bristle material selected should be resistant to attack by the particular acid being utilized. When fluosilicic acid is utilized, from about 0.03 to about 0.15 ml of 30% technical grade fluosilicic acid are applied per square centimeter of mold face surface area and the acid is allowed to remain on the surface of the mold face for a period of time from about 0.5 to about 5 minutes to give the acid time to attack the silicate material deposits and penetrate slightly beneath the surface of the mold face. Preferably, from about 0.05 to about 0.12 ml of 30% technical grade fluosilicic acid per square centimeter is allowed to remain on the mold face from about 1 to about 2 minutes. If hydrofluoric acid is utilized, from about 0.02 to about 0.15 ml per square centimeter are applied to the mold face and allowed to remain from about 0.5 to about 5 minutes to give the acid time to attack the accumulated silicate material and to soak in slightly beneath the surface of the mold face into the mold body.

After the acid has been allowed to remain in contact with the mold body for the desired period of time, a water spray is directed against the mold face. Either a fixed automatic sprinkler beneath which the mold moves on a conveyor or a hand held hose may be used. Initially, the water is allowed to penetrate beneath the surface of the mold face into the mold body. When the water has penetrated to the desired depth, compressed air is forced through the air supply means into the mold body and out through the mold face to purge the acid and water from the mold. The water rinse is maintained against the mold face during the first stages of the purging operation to ensure that all acid carried out by the air is rinsed away. After the water rinse and air purge have been carried on simultaneously for about 5 to 10 minutes, the water spray is terminated and the flow of compressed air through the mold is continued for an additional few minutes to thoroughly dry the mold body. The entire operation or individual steps thereof are repeated as necessary until the mold face is completely clean.

Another procedure for cleaning fouled molds involves initially forcing low pressure compressed air through the fluid supply conduit into the mold body to establish a slight flow of air out through the least fouled areas of the mold face; applying acid to the surface of the mold face in the previously described manner while maintaining the application of compressed air; continuing the application of compressed air to the mold body from about 0.5 to about 5 minutes after the application of acid to the mold face to maintain the acid on the fouled areas of the mold face surface; discontinuing the application of fluid pressure to the mold body from about 0.5 to about 5 minutes to allow acid to soak in beneath the surface of the mold face into the mold body; reapplying fluid pressure to the mold body; and removing the acid from the mold body as described hereinabove. Additional acid may be applied and the intermittent application of fluid pressure may be repeated as often as necessary until the surface of the mold face is completely cleaned prior to removing the acid from the mold body. Applying slight fluid pressure through the mold body while the acid is applied and continuing the application of fluid pressure for a period of time after the application of acid tends to displace the acid onto the more fouled portions of the mold face surface because compressed air leaking through the less fouled portions of the mold face surface pushes the acid aside onto the more fouled portions of the surface. The intermittent application of fluid pressure after the acid is applied also assists in dislodging accumulated material from the mold face after it has been loosened by the action of the acid.

If desired, fired ceramic molds may also be routinely treated with a fluorine containing acid after a given number of forming operations in order to remove accumulated silicate material and prevent sticking before it occurs. For example, if experience shows that sticking commonly occurs between seven and eight thousand forming operations, routine treatment of the molds after every six thousand forming operations will prevent sticking problems from occuring.

Because the fluorine containing acids utilized in the invention are highly corrosive, purged acid and rinse water containing the acid should be carefully collected in acid resistant collection means. Further dilution of the acid may be advisable to prevent etching of floors or sewers. All operations should be performed under a hood to prevent contamination of the work area by acid fumes. Appropriate safety equipment such as rubber gloves, rubber apron, rubber boots, eye goggles or face shield and respiration equipment should be provided for all persons working in the area.

Figure 6:
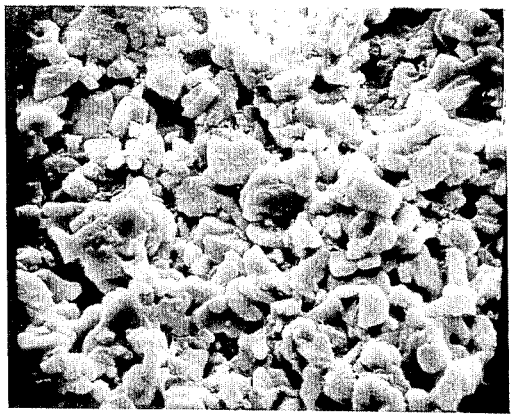
FIG. 6 is a microphotograph of the surface of a mold of the type illustrated in FIG. 1 which has been reconditioned by treating with 30% fluosilicic acid.

FIG. 6 is a photomicrograph of a used mold after cleaning with 30% technical grade fluosilicic acid. It is apparent that the accumulated material has been effectively removed. Significantly, no noticeable attack on the ceramic mold body can be seen.

Figure 7:
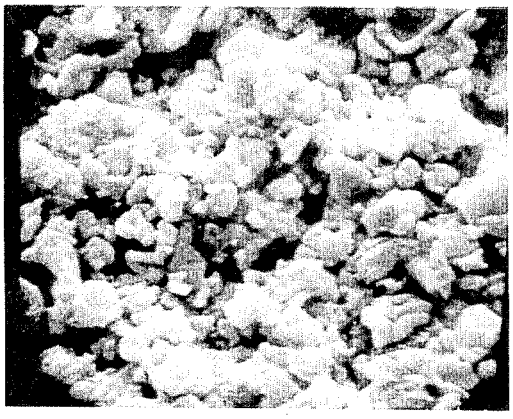
FIG. 7 is a microphotograph of the surface of a mold of the type illustrated in FIG. 1 which has been reconditioned by treating with hydrofluoric acid.

FIG. 7 is a photomicrograph of a used mold which has been cleaned with 52% hydrofluoric acid. Effective removal of the accumulated material is evident. From the photomicrograph it appears that the acid has slightly attacked the ceramic material of the mold, but only to a negligible extent.

The invention will be further explained with reference to the following examples:

EXAMPLE 1

The mold face of a used, alumina containing ceramic mold body of the type illustrated in FIG. 1 was wiped off with a sponge, and a layer of fluosilicic acid, 30% technical grade, was brushed with a nylon bristle brush onto the mold face which had become fouled with accumulated material from the plastic clay composition formed by the mold. Approximately 0.1 ml of acid was applied per square centimeter of mold face surface area. The acid was allowed to remain in contact with the mold face and to soak in beneath the surface of the mold face into the mold body for a period of about 2 minutes.

Water was then sprayed against the surface of the mold face to rinse away the acid. About 10 seconds after the application of the water spray, compressed air at about 60 psi was forced through the air supply means into the porous mold body and out the mold face in order to purge acid and water from the mold body. The water spray and flow of compressed air were maintained simultaneously for a period of 10 minutes whereupon the water spray was terminated and the flow of compressed air through the mold body was continued for an additional ten minutes to remove any remaining rinse water and thoroughly dry the mold. The foregoing process was repeated a total of four times after which the surface of the mold face was completely clean and the fluid permeability of the mold restored.

EXAMPLE 2

The mold face of a used, alumina containing ceramic mold body of the type illustrated in FIG. 1 was wiped off with a sponge, and the mold face, which had become fouled with material accumulated from the clay pressed by the mold, was treated with 52% hydrofluoric acid solution. About 0.12 ml of hydrofluoric acid solution were applied per square centimeter of mold face surface area with a camel's hair bristle brush. Three minutes after application of the acid, a water spray was directed against the mold face. Compressed air at 60 pounds pressure was passed through the mold air supply means into the mold body and out through the mold face starting about ten seconds after the application of the water spray, and the water spray and flow of compressed air were continued simultaneously. After ten minutes of simultaneous operation, the water spray was discontinued. The flow of compressed air was continued for an additional five minutes until the mold was free of water. The foregoing treatment was repeated a total of six times, after which the surface of the mold face was completely cleaned of all accumulated material from the clay. Negligible attack by the acid on the alumina composition of the mold body occurred.

EXAMPLE 3

A used, alumina containing ceramic fluid-release mold body provided with means to supply pressurized fluid to the mold body which had become fouled with silicate material accumulated from the plastic clay composition formed by the mold was cleaned according to the following procedure. Pressurized air at 30 pounds of pressure was applied to the mold body through the fluid applying means. Initially the surface of the mold face was so fouled that only a slight flow of air through localized portions of the mold face resulted when the pressurized air was applied. While maintaining the application of fluid pressure, the surface of the mold face was painted with about 0.08 ml 30% fluosilicic acid per square centimeter with a nylon bristle brush. After the entire surface of the mold face had been coated with acid, the fluid pressure was continued for a period of about two minutes. Air exiting through the mold face had the effect of pushing acid away from the open portions onto the fouled portions of the mold face. The application of fluid pressure was then discontinued for a period of about two minutes to allow acid to soak into the porous mold body beneath the surface of the mold face. After two minutes, the acid had penetrated beyond the depth of the accumulated material, and the fluid pressure was reapplied to the mold body and maintained for an additional two minute interval. The discontinuation and reapplication of fluid pressure was repeated ten times, with additional acid being applied to the surface of the mold face at intervals throughout the procedure when it appeared that the surface of the mold face was no longer completely wet by the acid. The intermittent application of fluid pressure dislodged particles of accumulated material which had been loosened from the mold face by the action of the acid. After ten cycles of the fluid pressure, the pressure was again discontinued and the mold face of the mold body was sprayed with water. The water was allowed to penetrate down into the mold beneath the surface of the mold face. Fluid pressure was thereafter reapplied at 60 psi for a period of ten minutes while the spray of water on the mold face was continued. The water was then turned off and the flow of air through the mold and out the mold face was continued for an additional ten minutes to purge and dry the mold body. Upon completion of the treatment, the surface of the mold was completely cleaned and the mold was ready for reuse.

EXAMPLE 4

A used, alumina containing ceramic fluid-release mold provided with means to supply pressurized fluid to the mold body, the surface of which had become fouled with material accumulated from the plastic composition pressed by the mold, was treated in the following manner. The mold was wiped clean with a sponge and pressurized air was passed through the mold to remove all moisture possible. About 0.15 ml of 30% fluosilicic acid per square centimeter was applied over the entire surface of the mold face with a nylon bristle brush. Two to three minutes after the application of the acid, compressed air at approximately 60 psi was applied to the mold body through the air supply means for a period of about one minute. The application of compressed air was thereafter discontinued for a period of about one minute. The air cycle was then repeated an additional two times. Thereafter an additional application of acid was made to the surface of the mold face followed by three more cycles of intermittent applications of compressed air. Water under a pressure of about 100 psi was then applied to the mold body through the air supply means to flush out the mold body. The flow of water was continued for ten minutes after the water started coming through the mold face of the mold body and then 60 psi compressed air was applied to the mold body through the air supply means to purge the water from the mold. As soon as water stopped coming out through the mold face, the fluid supply conduit was reconnected to the water source, and the water flushing was repeated for an additional ten minute period. Compressed air was then used to completely purge the die of water and dry it which took about another twenty minutes. The mold was then completely cleaned and ready for reuse.

EXAMPLE 5

The procedure of Example 1 was followed except the acid utilized was hydrochloric acid. The treatment was unsuccessful in removing the accumulated material from the surface and pores of the mold body.

EXAMPLE 6

The procedure of Example 1 was followed except the acid utilized was sulfuric acid. The treatment was unsuccessful in removing the accumulated material from the surface and pores of the alumina containing ceramic mold body.

EXAMPLE 7

The procedure of Example 1 was repeated except the acid utilized was nitric acid. The treatment was unsuccessful in removing the accumulated material from the surface and pores of the ceramic mold body.

EXAMPLE 8

The procedure of Example 1 was followed except kerosene solvent was substituted for the acid cleaning medium, and the water rinse was preceded by rinsing with a detergent solution. The treatment was unsuccessful in removing the accumulated material from the surface and pores of the ceramic mold body.

EXAMPLE 9

The procedure of Example 1 was repeated except the acid utilized was acetic acid. The treatment was unsuccessful in removing the accumulated material from the fouled surface of the ceramic mold body.

EXAMPLE 10

The procedure of Example 1 was repeated except concentrated sodium hydroxide solution was substituted for the acid. The treatment was unsuccessful in removing the accumulated material from the fouled ceramic mold body.

EXAMPLE 11

The procedure of Example 1 was repeated except ammonium hydroxide solution was substituted for the acid. The treatment was unsuccessful in removing the accumulated material from the surface and pores of the ceramic mold body.

EXAMPLE 12

The procedure of Example 1 was followed except potassium hydroxide solution was utilized instead of the acid. The treatment was unsuccessful in removing accumulated silicate material from the mold body.

EXAMPLE 13

The procedure of Example 1 was followed except gasoline was utilized in place of the acid cleaning solution and the water rinse was omitted. The treatment was unsuccessful in cleaning the fouled ceramic mold body.

The specific activity of the fluorine containing acids for the silicate material which fouls the surfaces of the mold bodies and causes sticking of the formed clay ware is surprising in view of the inability of all other substances tested to remove the accumulated material from the mold face and pores of the mold body.

By chemically removing accumulated silicate material without destruction of the surface of the mold face it is possible to greatly extend the service life of a ceramic fluid release mold. The service life of the mold is then limited only by the strength and wear resistance of the ceramic mold body itself. Projected service lives may range as high as two hundred thousand or more forming operations.

It will be apparent that numerous modifications of the foregoing procedures are possible. For example, other methods of applying the acid to the mold face surface of the mold body might be utilized. Likewise other procedures might be used to remove the acid from the treated mold bodies. All such equivalent procedures should be considered to be within the scope of the invention.

The foregoing examples have been described merely as illustrative embodiments of the invention and are not intended to limit the scope thereof. Since modifications will undoubtedly occur to those skilled in the art, the scope of the invention is to be determined solely with reference to the appended claims.

I claim:

1. A method of restoring the fluid permeability of a used, ceramic, fluid-release mold body comprising at least 70% alumina and having a mold face on one exterior surface thereof, said mold face having accumulated thereon a quantity of amorphous, silicon containing material restricting the fluid permeability of said mold body, said method comprising the steps of:

a. applying to said mold face an effective amount of fluorine containing acid capable of chemically removing said accumulated material from said mold face without significant damage to the mold body;
b. maintaining contact between said acid and said mold body for a period of time sufficient for said acid to attack said accumulated material, and
c. thereafter removing said acid from said mold body.

2. A method as recited in claim 1 wherein the fluorine containing acid is selected from the group consisting of hydrofluoric acid, fluosilicic acid, hexafluorophosphoric acid, fluosulfonic acid, trifluoracetic acid and fluorophosphoric acid.

3. A method as recited in claim 2 wherein said fluorine containing acid is hydrofluoric acid.

4. A method as recited in claim 2 wherein said fluorine containing acid is fluosilicic acid.

5. A method as recited in claim 1 wherein the removal of acid from the mold body is effected by forcing air through the acid treated mold body to purge acid from the mold body.

6. A method as recited in claim 1 wherein the removal of the acid from the mold body is effected by rinsing the acid treated mold body with water.

7. A method as recited in claim 6 further comprising the additional step of subsequently purging the porous mold body with compressed air to remove the rinse water.

8. A method as recited in claim 6 wherein said rinsing is effected by forcing water through the mold body and out the mold face to flush acid from the mold body and rinse the mold body.

9. A method as recited in claim 8 comprising the additional step of forcing compressed air through the porous mold body and out the mold face to purge water from the mold body.

10. A method as recited in claim 1 wherein the mold face is treated with from about 0.03 to about 0.15 ml of 30% fluosilicic acid per square centimeter for a period of time from about 0.5 to about 5 minutes.

11. A method as recited in claim 10 wherein the mold face is treated with from about 0.05 to about 0.12 ml of 30% fluosilicic acid per square centimeter for a period of time from about 1 to about 2 minutes.

12. A method as recited in claim 1 wherein the mold face is treated with from about 0.02 to about 0.15 ml of 52% hydrofluoric acid per square centimeter for a period of time from about 0.5 to about 5 minutes.

13. A method of maintaining the fluid permeability of a fired ceramic, fluid-release mold body comprising at least 70% alumina; said mold body having a mold face formed thereon and being provided with means to apply pressurized fluid to said mold body; said method comprising:

a. applying pressurized air to said mold body through the fluid applying means;

b. applying to said mold face an effective amount of a fluorine containing acid capable of chemically removing accumulated, amorphous silicon containing material from said mold face without significant damage to the mold body while maintaining the application air pressure;

c. continuing the application of air pressure to said mold body for a period of time from about 0.5 to about 5 minutes after application of acid to the mold face;

d. discontinuing the application of air pressure to said mold body for a period of time from about 0.5 to about 5 minutes and then reapplying air pressure to said mold body;

e. repeating steps (c) and (d) from 0 to 10 times, and f. removing the acid from said mold body.

14. A method as recited in claim 13 wherein the removal of acid from the mold body is effected by:

a. discontinuing the application of air pressure to the mold body, b. spraying the mold face of the mold body with water, and c. reapplying air pressure to the mold body while continuing to spray the mold face with water.

15. A method as recited in claim 13 wherein the fluorine containing acid is selected from the group consisting of hydrofluoric acid, fluosilicic acid, hexafluorophosphoric acid, fluosulfonic acid, trifluoracetic acid and fluorophosphoric acid.

16. A method as recited in claim 15 wherein said fluorine containing acid is hydrofluoric acid.

17. A method as recited in claim 15 wherein said fluorine containing acid is fluosilicic acid.

18. A method as recited in claim 16 wherein the mold face is treated with from about 0.03 to about 0.15 ml of 30% fluosilicic acid per square centimeter.

19. A method as recited in claim 18 wherein the mold face is treated with from about 0.05 to about 0.12 ml of 30% fluosilicic acid per square centimeter.

20. A method as recited in claim 17 wherein the mold face is treated with from about 0.02 to about 0.15 ml 52% hydrofluoric acid per square centimeter.

21. A method as recited in claim 13 wherein the pressure of the pressurized air applied to said mold body lies in the range from about 10 to about 100 pounds per square inch.

22. A method as recited in claim 21 wherein the pressure of the pressurized air applied to the mold body lies in the range from about 30 to 60 pounds per square inch.

23. A method as recited in claim 13 wherein steps (c) and (d) are repeated from 3 to 6 times.

24. A method as recited in claim 13 wherein steps (b), (c) and (d) are repeated.

25. A method of preventing sticking of a formed clay article to the mold face of a predominantly alumina, ceramic, fluid-release mold on which it is formed due to accumulated silicate material from the clay fouling the surface of the mold face, said method comprising periodically applying to the mold face an effective amount of a fluorine containing acid capable of chemically removing said accumulated material from said mold face without significant damage to the mold body and thereafter removing the acid together with accumulated silicate material from the mold body.

26. A method of maintaining the fluid permeability of a fired ceramic, fluid-release mold body comprising at least 70% alumina; said mold body having a mold face formed thereon and being provided with means to apply pressurized fluid to said mold body; said method comprising:

a. applying to the mold face an effective amount of a fluorine containing acid capable of chemically removing accumulated, amorphous, silicon containing material from said mold face without significant damage to the mold body;

b. thereafter applying pressurized air to said mold body through the fluid applying means for a period of time from about 0.5 to about 5 minutes;

c. discontinuing the application of air pressure to said mold body for a period of time from about 0.5 to about 5 minutes and then reapplying air pressure to said mold body;

d. repeating steps (b) and (c) from 0 to 10 times, and e. removing the acid from said mold body.

27. A method as recited in claim 26 wherein the fluorine containing acid is selected from the class consisting of hydrofluoric acid, fluosilicic acid, hexafluorophosphoric acid, fluosulfonic acid, trifluoracetic acid and fluorophosphoric acid.

28. A method as recited in claim 27 wherein said fluorine containing acid is hydrofluoric acid.

29. A method as recited in claim 27 wherein said fluorine containing acid is fluosilicic acid.

30. A method as recited in claim 26 comprising the additional step of subsequently forcing water through the mold body and out the mold face to flush acid from the die and rinse the die.

31. A method as recited in claim 30 comprising the additional step of forcing compressed air through the porous mold body and out the mold face to purge water from the die.

* * * * *